United States Patent [19]

Thomas

[11] 4,398,973

[45] Aug. 16, 1983

[54] TRAVERSE ANNEALER

[75] Inventor: O. Leon Thomas, Carrollton, Ga.

[73] Assignee: Southwire Company, Carrollton, Ga.

[21] Appl. No.: 314,905

[22] Filed: Oct. 26, 1981

[51] Int. Cl.[3] ..... C21D 9/52; C21D 9/62;

[52] U.S. Cl. ..... 148/154; 266/103

[58] Field of Search ..... 266/103, 104; 148/154, 148/150

[56] References Cited

U.S. PATENT DOCUMENTS 2,589,283 7/1949 O'Grady ..... 266/104

3,799,518 3/1974 Barone ..... 266/104

*Primary Examiner*—L. Dewayne Rutledge

*Assistant Examiner*—Debbie Yee

*Attorney, Agent, or Firm*—Herbert M. Hanegan; Stanley L. Tate; Michael C. Smith

[57] ABSTRACT

Disclosed is an improved system for annealing strand of the type comprising at least two sheaves across which the strand passes and becomes electrically annealed, the improvement comprising a first flange member, a second flange member concentric with the first flange member and adjacent thereto, a wide annealing band positioned between the first and second flange members and forming the bottom of a sheave groove, and means for guiding the strand being annealed traversely across a traverse zone of the band to increase longevity of the band while substantially eliminating detrimental arcing by providing an insulating air gap between the strand and either of the flange members.

18 Claims, 2 Drawing Figures

TRAVERSE ANNEALER

TECHNICAL FIELD

The present invention relates generally to annealing, and specifically to a wide band annealing mechanism comprising a wide annealer band and a traverse apparatus adapted to continuously physically guide the strand being annealed in reciprocal lateral movement to increase band and sheave longevity by distributing wear, and to prevent arcing by avoiding contact or near-contact of the strand with flanges of the annealer sheave and by maintaining contact between the strand and the annealer band.

BACKGROUND ART

Annealing is the well known art of heat treating metals and is used to temper strands of metal such as wire or cable. The early art introduced batches of product into an oven for annealing but the process was slow and expensive. Continuous processes such as those shown in U.S. Pat. Nos. 1,993,400 and 2,726,971 were developed to continuously anneal wire by passing it along a series of rollers which apply electric current to the advancing wire to heat it as desired. A similar process for annealing cable is taught by U.S. Pat. No. 3,746,582. Originally, the rollers comprised sheaves having a groove in which the advancing strand traveled. It was found that the strand quickly wore out the sheaves because of continuous abrasion so replaceable sheave inserts such as the one shown in West German Pat. No. DT 25 20 161 were developed.

The insert is normally an endless flat strip forming the base of the groove while the flange portions form the side walls. Although the replacable insert decreases wear on the sheaves somewhat, sheave wear has remained unacceptably high until the present invention because the strand had no propensity to remain in contact only with the insert. Instead, the strand normally moved to one side and began to wear the sheave wall. In addition to having no tendency to remain centered on the insert surface, the strand even if not a magnetic material is often actually attracted to one side by the eddy current fields which are influenced by the mass of the annealer structure.

Where by chance the strand remains in contact only with the insert, an abrasion in the insert is relatively quickly worn and the insert is soon scared by an increasingly deep rut. Thus, in addition to wearing out the inner flange surfaces of the sheaves, the strand quickly wears out the insert which is designed to receive the bulk of the wear. Another problem is arcing which causes burn pits to the strand and to the insert and sheaves. The present invention solves the insert and sheave wear and most arcing problems by providing an annealing apparatus comprising a wide annealer band which is continuously traversed by the strand being annealed, extends the life of the band, and substantially eliminates detrimental arcing.

DISCLOSURE OF INVENTION

The present invention is a wide band, strand traversing annealer apparatus. It comprises a wide annealer band which is physically traversed by the strand being annealed along a predetermined central portion thereof to prevent abrasion to other portions of the apparatus, evenly distribute wear to the band, and substantially eliminate detrimental arcing. Thus both the flange and band portions of the present invention have greatly extended lives. While the band and flange portions may be separate components, they may be indivisible units of the annealer sheave.

Therefore, a major object of this invention is to provide a strand annealer adapted to anneal wire or cable, having extended useful life, and adapted to prevent most arcing.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with accompaning drawings in which like parts are given like identification numerals and wherein:

BEST MODE FOR CARRYING OUT THE INVENTION

Figure 1:
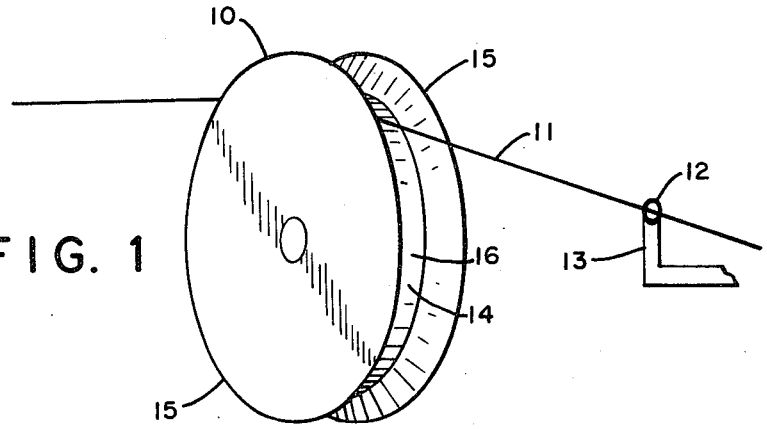
FIG. 1 is a perspective view of a portion of a strand annealing machine comprising the present invention.

The present invention is a wide band traversing strand annealer. As FIG. 1 illustrates, the sheave 10 is part of an annealing system which cooperates with similar sheaves and electrical current control means (not shown) to apply a current to a length of strand 11 such as wire or cable between two sheaves thereby heating and annealing the strand 11. The strand 11 passes through an eyelet 12 of a traverse device 13 which is adapted to guide the strand 11 laterally so that it gradually moves repeatedly left and right along a predetermined traverse zone 16 on the hardened surface of the annealer band 14. Traverse zone 16 has a width of from about 0.25 inches (6.35 mm) to about 4 inches (101.6 mm) and is longitudinally concentric with the annealer band 14. The lateral movement is at a slow rate of from about 2 inches (50.8 mm) per minute to about 4 inches (101.6 mm) per minute to prevent any significant lateral friction between the strand 11 and the band 14 while also minimizing friction between the strand 11 and the eyelet 12.

Eyelet 12 comprises a hard insulating material to resist abrasion while preventing the annealing current from grounding through traverse device 13. The preferred eyelet material is a ceramic such as aluminum oxide.

Figure 2:
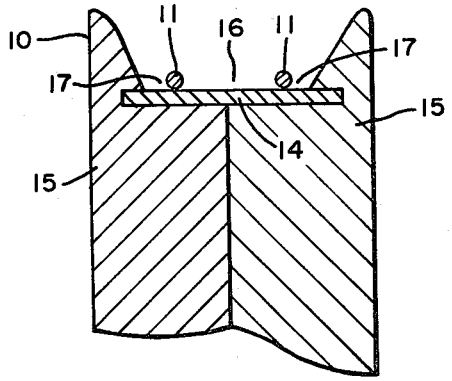
FIG. 2 is a partial cross sectional view of the sheave of the present invention.

While the annealer band 14 and the flanges 15 may be indivisible portions of the annealer sheave 10, they may instead be separable components as illustrated in FIG. 2. The traverse zone 16 can be seen in FIG. 2 where its left and right extremities are defined by wires 11. As the annealer sheave 10 rotates, the strand 11 advances and traverses the zone 16 on the surface of the band 14. The lateral movement prevents abrasion such as wearing of a small groove in the band 14. Instead, wear is distributed over the entire zone 16. Thus for example, a copper wire 11 with a diameter of 0.076 inch (1.9 mm) being annealed on the present invention and being traversed along a 1.5 inch (38.1 mm) wide zone 16, the useful life of band 14 can be increased from about 20,000 percent to about 30,000 percent over that of a conventional copper band.

The traverse zone 16 terminates at points from about 0.0625 inch (1.6 mm) to about 0.125 inch (3.2 mm) from the inner surface of each flange 15 to avoid arc inducing proximity. By maintaining these distances from the flanges 15, arcing between strand 11 and flange 15 is suppressed and substantially eliminated by the insulating air gap 17 formed on each side of the traverse zone 16, and the conventional expense of applying insulating material to the flange 15 surfaces is eliminated.

As strand 11 advances, eyelet 12 reciprocally deflects strand 11 only about 2 angular degrees from a straight path longitudinally concentric with the band 14. This limited deflection combines with the slow traverse rate of device 13 and the eyelet composition to minimize abrasion at traverse zone 16 and eyelet 12. In addition, the traverse device 13 dampens wire 11 vibration caused for example by variations in speeds of sheaves 10 to substantially eliminate detrimental arcing between strand 11 and band 14 caused by vibration induced loss of contact between strand 11 and band 14.

It is preferred that the band 14 be hardened molybdenum about 0.0625 inch (1.6 mm) thick. If the band 14 and flange 15 portions are one unit, the entire annealer sheave 10 should be made of steel and the band 14 area should be hardened to assure longevity. It is preferred that this hardening also be about 0.0625 inch (1.6 mm) deep as measured by the Rockwell 60 "C" scale of hardness.

Thus, while wear of the band 14 is greatly reduced, wear of the flanges 17 and burn pitting of the sheave 10 and the strand 11 are substantially eliminated.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitation in the wire and cable industry. It is particularly useful in a system for continuously annealing wire.

I claim:

1. In a system for annealing strand at high speed of the type comprising at least two sheaves across which said strand passes and becomes electrically annealed, the improvement comprising.

(a) a first flange member;

(b) a second flange member concentric with said first flange member and adjacent thereto;

(c) a hardened annealing band positioned between said first and second flange members and forming the bottom of a sheave groove; and (d) means for guiding said strand along a predetermined traverse zone on the surface of said band.

2. The apparatus of claim 1 wherein means (d) further comprises means for preventing contact between said strand and either of said flange members.

3. The apparatus of claim 1 wherein means (d) further comprises means for preventing arcing between said strand and either of said flange members.

4. The apparatus of claim 1 wherein means (d) further comprises means for dampening vibration of said strand.

5. The apparatus of claim 4 further comprising means for preventing loss of contact between said strand and said traverse zone.

6. The apparatus of claim 5 further comprising means for preventing arcing between said strand and said traverse zone.

7. The apparatus of claim 1 wherein means (d) further comprises means for distributing wear to said band.

8. The apparatus of claim 7 wherein said predetermined zone has a width of from about 0.25 inch (6.35 mm) to about 4 inches (101.6 mm), and is longitudinally concentric with said band.

9. The apparatus of claim 8 wherein said band is hardened to a depth of about 0.0625 inch (1.6 mm).

10. The apparatus of claim 9 characterized by an increase in the useful life of said band from about 20,000 percent to about 30,000 percent over that of a conventional copper band.

11. The apparatus of claim 1 further comprising insulating air gaps on both lateral sides of said traverse zone having widths of from about 0.0625 inch (1.6 mm) to about 0.125 inch (3.2 mm).

12. The apparatus of claim 1 wherein means (d) further comprises.

(a) an eyelet through which said strand passes; and (b) reciprocating means for repeatedly moving said eyelet limited distances in directions lateral to the longitudinal axis of the strand path while deflecting said strand a maximum of about 2 angular degrees.

13. The apparatus of claim 12 wherein said eyelet further comprises a hard insulating material such as aluminum oxide ceramic.

14. A method for annealing strand traveling at high speed across an annealing sheave comprising the steps of:

(a) providing a wide hardened band between the flanges of said sheave; and (b) guiding said strand repeatedly back and forth laterally along a predetermined traverse zone on the surface of said band and longitudinally concentric therewith.

15. The method of claim 14 further comprising the step of dampening vibration of said strand to prevent loss of contact between said strand and said traverse zone to prevent detrimental arcing therebetween.

16. The method of claim 14 further comprising the step of traversing said traversing zone at a rate of from about 2 inches (50.8 mm) per minute to about 4 inches (101.6 mm) per minute.

17. The method of claim 14 further comprising the step of providing a space from about 0.0625 inch (1.6 mm) to about 0.125 inch (3.2 mm) wide on each lateral side of said traverse zone to prevent abrasive contact between said strand and said flanges, and to provide an insulating air gap on each side of said traverse zone to prevent detrimental arcing between said strand and said flanges.

18. The method of claim 14 further comprising the step of providing a hardened traverse zone having a depth of about 0.0625 inch (1.6 mm) and a width of about 1.5 inches (38.1 mm) to distribute wear by said strand such that while annealing a copper strand having a diameter of 0.076 inch (1.9 mm) the useful life of said band is increased from about 20,000 percent to about 30,000 percent over that of a conventional copper band.

* * * * *